US008770285B2

(12) United States Patent
McGregor

(10) Patent No.: US 8,770,285 B2
(45) Date of Patent: Jul. 8, 2014

(54) SYSTEMS AND METHODS FOR LOCATING WELLBORE SERVICING TOOLS WITHIN A WELLBORE

(71) Applicant: Halliburton Energy Services, Inc., Houston, TX (US)

(72) Inventor: Ben Colin McGregor, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/847,315

(22) Filed: Mar. 19, 2013

(65) Prior Publication Data

US 2014/0041866 A1 Feb. 13, 2014

(51) Int. Cl.
*E21B 47/00* (2012.01)

(52) U.S. Cl.
USPC ..... 166/255.2; 166/255.1

(58) Field of Classification Search
CPC ..... E21B 23/02; E21B 47/09
USPC ..... 166/255.1, 255.2, 382, 387
See application file for complete search history.

(56) References Cited

U.S. PATENT DOCUMENTS 3,638,723 A 2/1972 Carroll
5,538,082 A * 7/1996 Zwart ..... 166/382
6,267,180 B1 7/2001 Gazda et al.
7,385,523 B2 * 6/2008 Thomeer et al. ..... 340/854.8
2006/0225878 A1 10/2006 Coronado
2009/0159296 A1 * 6/2009 Fay et al. ..... 166/382
2009/0229838 A1 * 9/2009 Richard et al. ..... 166/387
2009/0266556 A1 10/2009 Swenson et al.
2009/0294124 A1 12/2009 Patel

OTHER PUBLICATIONS

International Search Report and Written Opinion for PCT/US2012/049837 dated Feb. 19, 2013.

* cited by examiner

*Primary Examiner* — Shane Bomar
*Assistant Examiner* — Kipp Wallace
(74) *Attorney, Agent, or Firm* — McDermott Will & Emery LLP; Scott F. Wendorf

(57) ABSTRACT

Disclosed are methods and systems for accurately locating wellbore servicing tools within a wellbore. A positioning system includes an elongate housing defining a piston bore with first and second axial ends, a sleeve arranged within the piston bore and having an upset extending radially outward therefrom, one or more lugs arranged within the elongate housing and radially movable when acted upon by the upset, a first biasing device arranged within the piston bore at the second axial end, and at least one RFID tag arranged on the production tubular and configured to communicate with at least one RFID reader arranged on the elongate housing, the at least one RFID reader being configured to deploy the first biasing device upon communicating with the at least one RFID tag, and thereby force the sleeve toward the first axial end and the upset into engagement with the lugs which engage a profile.

21 Claims, 4 Drawing Sheets

SYSTEMS AND METHODS FOR LOCATING WELLBORE SERVICING TOOLS WITHIN A WELLBORE

CROSS-REFERENCE TO RELATED APPLICATIONS

The present application is a continuation of and claims priority to International Application No. PCT/US2012/049837 filed on Aug. 7, 2012 under 35 U.S.C. §365(a) and §119.

BACKGROUND

The present invention relates to subterranean wellbore operations and, in particular, to accurately locating wellbore servicing tools within a wellbore.

In the oil and gas industry, it is often necessary to determine the exact downhole position of a wellbore servicing tool so that the intended operation can be undertaken at a predetermined downhole location. A variety of positioning tools exist for locating a servicing tool within the wellbore. For example, some positioning tools are configured to locate the servicing tool within the wellbore by inserting the positioning tool into the wellbore and causing mechanical interactions between the positioning tool and casing collars, pipe collars, and/or other downhole features within the wellbore.

While some mechanical positioning tools are suitable for interacting with a variety of downhole features, these positioning tools often wear or degrade various components within the wellbore and/or may themselves undergo an undesirable amount of mechanical wear and fatigue. As a result, current positioning tools exhibit inherent problems with repeatability. Further, since most positioning tools are designed to locate a particular component having a specific inner diameter, they are sometimes not well suited for traversing other components having varying inner diameters.

SUMMARY OF THE INVENTION

The present invention relates to subterranean wellbore operations and, in particular, to accurately locating wellbore servicing tools within a wellbore.

In some aspects of the disclosure, a positioning system for locating a wellbore servicing tool within a production tubular is disclosed. In some embodiments, the positioning system may include an elongate housing defining a piston bore having a first axial end and a second axial end, a sleeve arranged within the piston bore and being axially translatable between the first and second axial ends, the sleeve having at least one upset extending radially outward therefrom, one or more lugs arranged within the elongate housing and being radially movable when acted upon by the at least one upset, a first biasing device arranged within the piston bore at the second axial end and movable between a stowed configuration and a deployed configuration, and at least one RFID tag arranged on the production tubular and configured to communicate with at least one RFID reader arranged on the elongate housing, the at least one RFID reader being configured to deploy the first biasing device upon communicating with the at least one RFID tag, wherein, as the first biasing device expands axially, it forces the sleeve toward the first axial end, thereby forcing the upset into engagement with the one or more lugs which radially extend at least partially without the elongate housing and engage a profile arranged on an inner radial surface of the production tubular.

In other aspects of the disclosure, a method for locating a wellbore servicing tool within a production tubular is disclosed. In some embodiments, the method may include introducing the wellbore servicing tool into the production tubular, the wellbore servicing tool being coupled to an elongate housing defining a piston bore having a first axial end and a second axial end, communicating at least one RFID reader arranged on the elongate housing with at least one RFID tag arranged on the production tubular, and thereby deploying a first biasing device from a stowed configuration to a deployed configuration, the first biasing device being arranged within the piston bore at the second axial end, forcing a sleeve with the first biasing device toward the first axial end, the sleeve being arranged within the piston bore and having at least one upset extending radially outward therefrom, engaging the at least one upset on one or more lugs arranged within the elongate housing, and thereby radially extending the one or more lugs at least partially without the elongate housing, and engaging the one or more lugs on a profile arranged on an inner radial surface of the production tubular, thereby stopping an axial progression of the wellbore servicing tool.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates to subterranean wellbore operations and, in particular, to accurately locating wellbore servicing tools within a wellbore.

The exemplary positioning systems disclosed herein utilize radio frequency identification (RFID) technology and one or more actuators to accurately locate a servicing tool within a wellbore. At least one RFID reader may be placed on the servicing tool, and one or more RFID tags may be strategically placed along the length of the wellbore at predetermined intervals. Once the RFID reader recognizes the proximity of a corresponding RFID tag or a sequence of corresponding RFID tags, the positioning tool may be configured to actuate and accurately locate on a radial profile defined on the inner wall of the wellbore. As a result, wellbore operators will have increased confidence in the exact downhole position of the servicing tool. Moreover, since the disclosed positioning systems are mechanically actuatable, they allow an operator to selectively locate a servicing tool within the wellbore at several distinct locations exhibiting a range of differing inner diameter sizes. This will allow operators to pass through upper restrictions having a reduced inner diameter size that may have been previously impossible using prior positioning systems. Furthermore, one or more of the exemplary positioning systems are repeatable and allow the operator to retract and redeploy the systems multiple times without having to worry about material fatigue limits or mechanical fatigue failure.

Figure 1A:
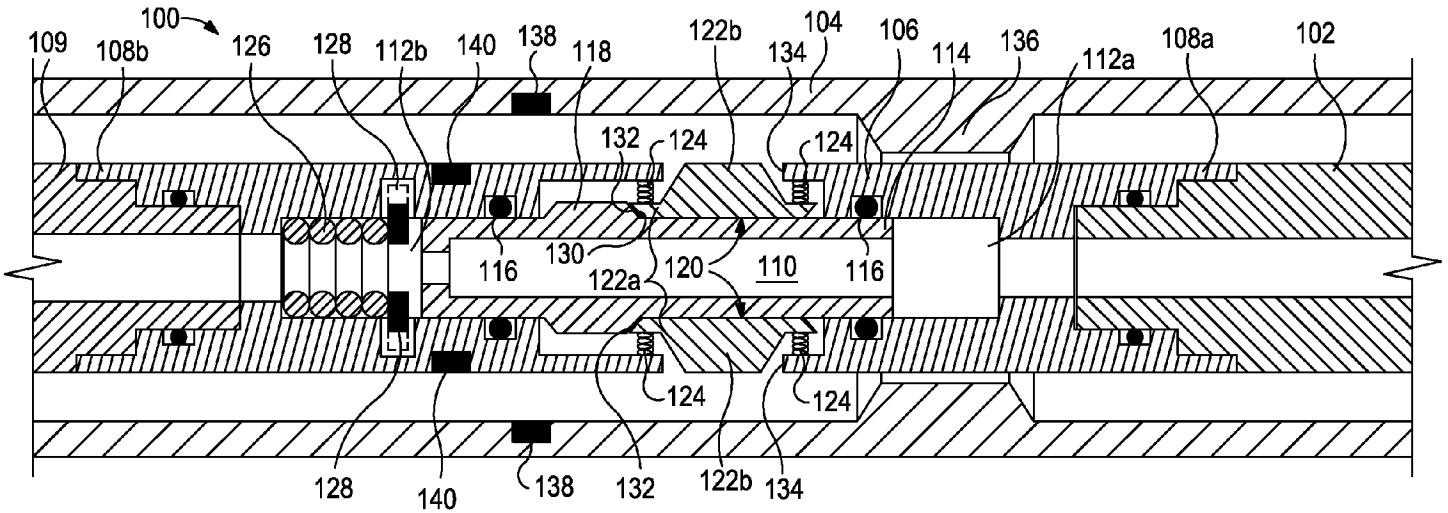
FIGS. 1A and 1B illustrate cross-sectional, progressive views of an exemplary positioning system, according to one or more embodiments.
Figure 1B:
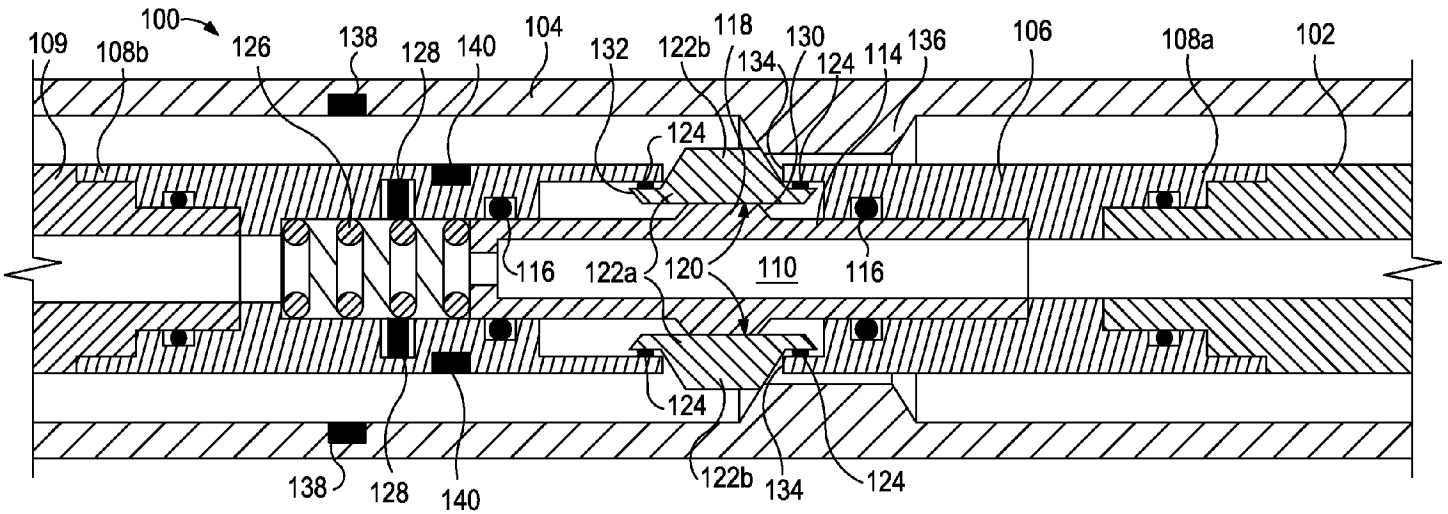

Referring to FIGS. 1A and 1B, illustrated are cross-sectional views of an exemplary positioning system 100, according to one or more embodiments. FIG. 1A depicts the positioning system 100 in a retracted configuration, while FIG. 1B depicts the positioning system 100 in a deployed configuration. In some embodiments, the positioning system 100 may be used to accurately locate a wellbore servicing tool 102 within a wellbore, such as within a production tubular 104 or similar tubular member arranged within the wellbore. For example, in some embodiments, the positioning system 100 may be useful in locating the servicing tool 102 in order to prevent the activation of a check valve. As used herein, "production tubular" refers to any cylindrical or tubular structure, member, or string including, but not limited to, casing, liner, coiled tubing, drill pipe, production tubing, and the like. Those skilled in the art will readily recognize, however, that the disclosed technology is not limited only to the oil and gas industry, but may also be equally used in other fields, without departing from the scope of the disclosure.

The positioning system 100 may include an elongate housing 106 having a distal end 108*a* and a proximal end 108*b*. In at least one embodiment, the distal end 108*a* may be coupled or otherwise attached to the wellbore servicing tool 102 and the proximal end 108*b* may be coupled or otherwise attached to a tubular string 109 that extends from, for example, a well surface. In other embodiments, however, both the distal and proximal ends 108*a,b* may form integral parts of the wellbore servicing tool 102. It should be noted that although FIGS. 1A and 1B depict a horizontal disposition of the production tubular 104, the positioning system 100 is equally applicable for use in production tubulars 104 or wellbores having other directional configurations including vertical, deviated, slanted or diagonal, combinations thereof, and the like. Moreover, use of directional terms such as above, below, upper, lower, upward, downward, uphole, downhole, and the like are used in relation to the illustrative embodiments as they are depicted in the figures, the upward or uphole direction being toward the surface of a well and the downward or downhole direction being toward the bottom or toe of the well.

The housing 106 may define a piston bore 110 having a first axial end 112*a* and a second axial end 112*b*. A sleeve 114 may be movably arranged within the piston bore 110 and configured to axially translate within the piston bore 110 between the first and second axial ends 112*a,b* upon being properly actuated. In at least one embodiment, the positioning system 100 may further include one or more seals 116 used to seal the sliding interface between the housing 106 and the sleeve 114 as the sleeve 114 axially translates within the piston bore 110. In some embodiments, the seals 116 may be radial seals, such as o-rings or the like, but in other embodiments the seals 116 may be any other suitable seal capable of sealing the interface between the housing 106 ad the sleeve 114. As depicted, each seal 116 may be disposed in a corresponding recess defined in the housing 106. In other embodiments, however, each seal 116 may be disposed in a recess defined in the sleeve 114, without departing from the scope of the disclosure.

The sleeve 114 may define at least one upset 118 (one shown) that extends or otherwise protrudes radially outward from the outer circumferential surface of the sleeve 114. As the sleeve 114 translates within the piston bore 110, the upset 118 may be configured to engage one or more lugs 120 (two shown) also generally arranged within the piston bore 110. As illustrated, the lugs 120 may include a base portion 122*a* and a head portion 122*b* extending radially from the base portion 122*a*. As the upset 118 engages the lugs 120, the upset 118 may be configured to slide underneath the lugs 120 or otherwise bias the lugs 120 radially outward with respect to the sleeve 114. In some embodiments, one or more springs 124 (two shown) may be used to radially bias the lugs 120 against the sleeve 114 or otherwise away from the inner radial surface of the piston bore 110. While the positioning system 100 is being introduced into the production tubular 104, the springs 124 may help maintain the lugs 120 generally within the piston bore 110 until acted upon by the upset 118.

In some embodiments, the positioning system 100 may further include a biasing device 126 arranged within the piston bore 110 at or near the second axial end 112*b*. In at least one embodiment, the biasing device 126 may be a spring, such as a helical compression spring, or the like. As illustrated in FIG. 1A, the biasing device 126 is in its stowed configuration, and one or more actuators 128 (two shown) may be included in the positioning system 100 and configured to maintain the biasing device 126 in its stowed configuration until properly released at a predetermined time. In some embodiments, the actuators 128 may be linear actuators such as, but not limited to, mechanical actuators, electromechanical actuators, pneumatic actuators, hydraulic actuators, piezoelectric actuators, relays, comb drives, thermal bimorphs, digital micromirror devices, an electroactive polymer, combinations thereof, and the like. The actuators 128 may be directly or remotely controlled, as known in the art.

In at least one embodiment, the actuators 128 may comprise a solenoid and plunger assembly, where the plunger is movably arranged within the solenoid and able to extend and retract radially on command. When radially extended, as shown in FIG. 1A, the plunger may be configured to hold back the biasing device 126 and otherwise maintain the biasing device 126 in its stowed configuration. When the plunger is retracted radially, however, as depicted in FIG. 1B, the biasing device 126 may be free to expand or extend axially within the piston bore 110.

As the biasing device 126 axially expands, it may be configured to engage and force the sleeve 114 toward the first axial end 112*a* of the piston bore 110. In some embodiments, at least one axial end of the upset 118 may define a beveled surface 130 configured to engage a corresponding beveled surface 132 defined on the lugs 120. As the sleeve 114 moves axially toward the first axial end 112*a*, the corresponding beveled surfaces 130, 132 may slidably engage each other, thereby forcing the upset 118 underneath each lug 120 and correspondingly forcing each lug 120 radially outward. As the lugs 120 are forced radially outward, the springs 124 are compressed between the inner radial surface of the piston bore 110 and each lug 120, and the head portion 122*b* of each lug 120 may extend through corresponding perforations or holes 134 defined in the housing 106.

With the lugs 120 radially extended through the corresponding holes 134 in the housing 106, the head portion 122*b* of each lug 120 may be configured to engage a profile 136 defined on and/or otherwise extending radially inward from the inner circumferential surface of the production tubular 104. As illustrated, the profile 136 may exhibit an inner diameter that is less than the inner diameter of the production tubular 104. In some embodiments, the profile 136 may be an annular ring coupled or otherwise attached to the inner circumferential surface of the production tubular 104. In other embodiments, however, the profile 136 may be an integral part of the production tubular 104 and machined or formed therein to provide the decreased diametric dimension. In some embodiments, as illustrated, the profile 136 may be characterized as a "downstop" configured to stop the axial descent of the wellbore servicing tool 102 once properly engaged by the lugs 120. As will be appreciated, however, in other embodiments the profile 136 may be equally characterized as an "up stop" configured to stop the axial ascent of the wellbore servicing tool 102 as it is pulled upwards within the production tubular 104 or wellbore.

In order to actuate the positioning system 100, and thereby radially extend the lugs 120 into engagement with the profile 136, the positioning system 100 may further employ radio frequency identification (RFID) technology. Briefly, RFID technology employs electromagnetic energy to remotely read an electronic RFID "tag" placed on a body or device in order to identify the body or device. The information that is read by a corresponding RFID "reader" can be of any desired type for which a particular implementation is adapted (e.g., an indication that the RFID tag is present, a unique identity code, or several kilobytes of information). As used herein, the electromagnetic signal that is transmitted or otherwise conveyed between the RFID tag(s) and RFID reader(s) includes any electromagnetic emission intended to cause the RFID reader to respond or otherwise act. As will be appreciated, this includes, for example, the mere presence of an electromagnetic field and a discrete encoded electromagnetic transmission.

Still referring to FIGS. 1A and 1B, the positioning system 100 may further include one or more RFID tags 138 (two shown) configured to communicate with one or more RFID readers 140 (two shown). As illustrated, the RFID tags 138 may be coupled or otherwise attached to the production tubular 104, and the RFID readers 140 may be coupled or otherwise attached to the outer circumferential surface of the housing 106. In some embodiments, one or more of the RFID tags 138 and RFID readers 140 may be encased within a housing (not shown) or the like in order to provide protection from external contamination or damage. However, in other embodiments, as illustrated, one or more of the RFID tags 138 and/or RFID readers 140 may be arranged in a recessed pocket defined in either the production tubular 104 or the outer circumferential surface of the housing 106. In such embodiments, the RFID tags 138 and/or RFID readers 140 may have a sealant or other material disposed thereon in order to provide a degree of protection from external contamination and/or damage. Exemplary materials that may be used to seal and protect the RFID tags 138 and/or RFID readers 140 include, but are not limited to, silicones, epoxies, plastics, rubbers, elastomers, cements, polyurethane, chlorinated polyethylene, thermoplastic polymers, non-soluble acrylic polymers, combinations thereof, and the like.

The RFID tags 138 and corresponding technology may be of any type or design known to those skilled in the art. In some embodiments, for example, the RFID tags 138 may be active, semi-active, or battery assisted passive (BAP). In other embodiments, however, one or more of the RFID tags 138 may be passive. Passive tags do not require a battery to operate and, therefore, are cheaper and smaller than other types of RFID tags. Passive tags instead contain an electromagnetic or electronic coil that can be excited by a particular frequency of electromagnetic energy transmitted from a corresponding RFID reader 140. The electromagnetic energy transmitted from the RFID reader 140 to the coil in the RFID tag 128 momentarily excites it (i.e., causes energizing or activating electrical current flow), causing an internal electrical circuit to transmit the contents of its buffer, such as some pre-stored value unique to that particular object, back to the RFID reader 140. The RFID reader 140 senses and reads the transmission from the RFID tag 138, and in response may undertake some predetermined action.

In one or more embodiments, the RFID readers 140 may be communicably coupled to the one or more actuators 128. Consequently, activating or exciting the RFID readers 140 may trigger operation of the actuators 128 which, therefore, triggers the actuation of the positioning tool 100 as generally described above. In operation, for example, as the wellbore servicing tool 102 and accompanying positioning system 100 proceed axially through the production tubular 104, the RFID readers 140 recognize the proximity of the corresponding RFID tags 138. Upon such recognition, the RFID readers 140 operate to trigger the actuators 128 which radially retract, thereby releasing the biasing device 126 which forces the sleeve 114 toward the first axial end 112*a* and simultaneously extends the lugs 120 radially as the upset 118 slides beneath each lug 120. With the lugs 120 extended through the holes 134 defined in the housing 106, the lugs 120 are able to engage the profile 136 and thereby stop the axial movement of the wellbore servicing tool 102.

Those skilled in the art will readily appreciate the advantages the disclosed positioning tool 100 provides. For example, the profile 136 may be strategically located within the production tubular 104 where the wellbore servicing tool 102 may be required to undertake some downhole operation. By strategically arranging the RFID tags 138 a short distance away from the profile 136, or otherwise at a predetermined location in proximity thereto, the positioning system 100 may be actuated just before encountering the profile 136, thereby accurately locating the wellbore servicing tool 102 at the desired profile 136. Since the lugs 120 are actuatable in the radial direction, they are able to remain recessed within the housing 106 until needed which allows the positioning tool 100 to traverse varying inner diameters of the production tubular 104 before encountering the profile 136. Moreover, the lugs 120 may be able to locate on profiles 136 having a variety of different inner diameter sizes, limited only on how far the lugs 120 are able to extend out of the housing 106.

Figure 2A:
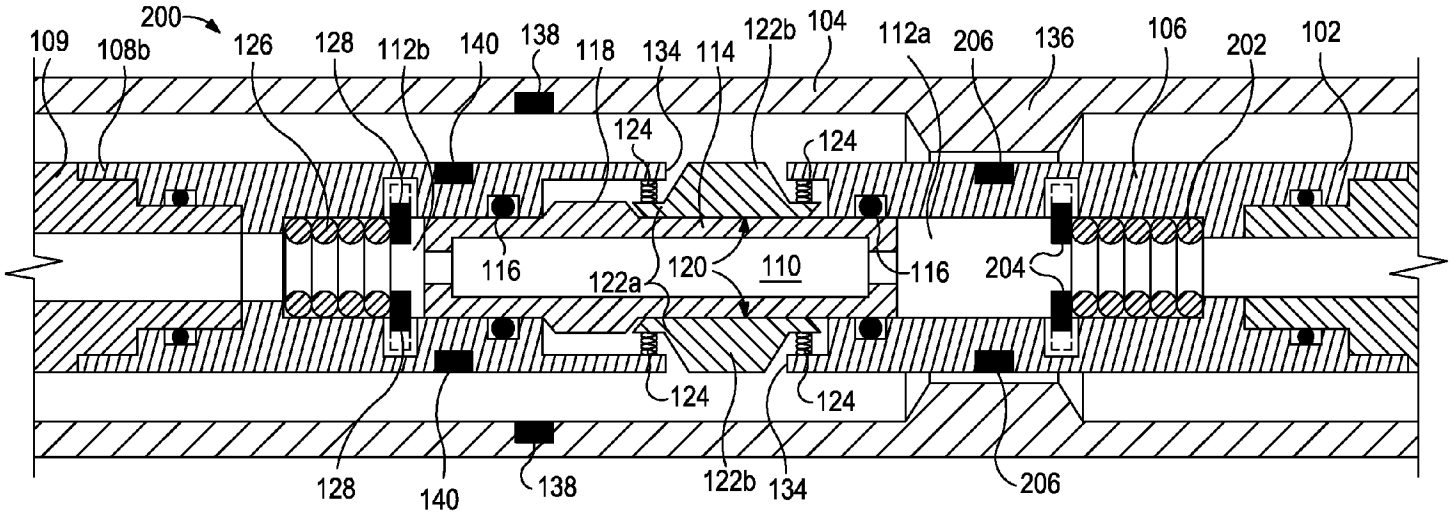
FIGS. 2A-2C illustrate cross-sectional, progressive views of another exemplary positioning system, according to one or more embodiments.
Figure 2B:
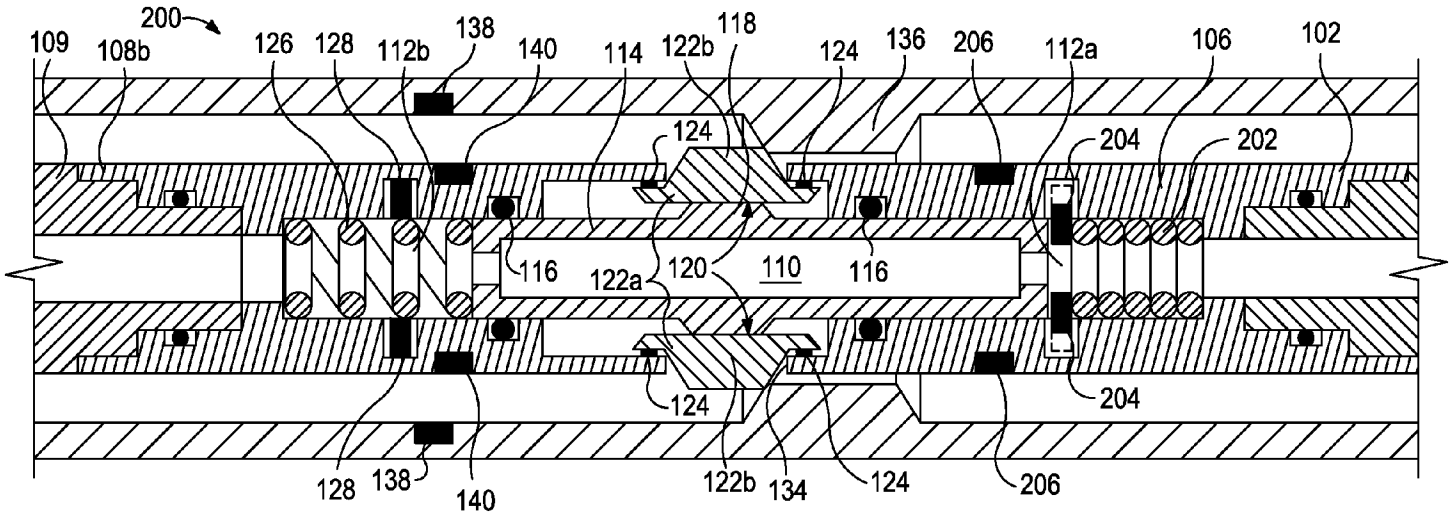
Figure 2C:
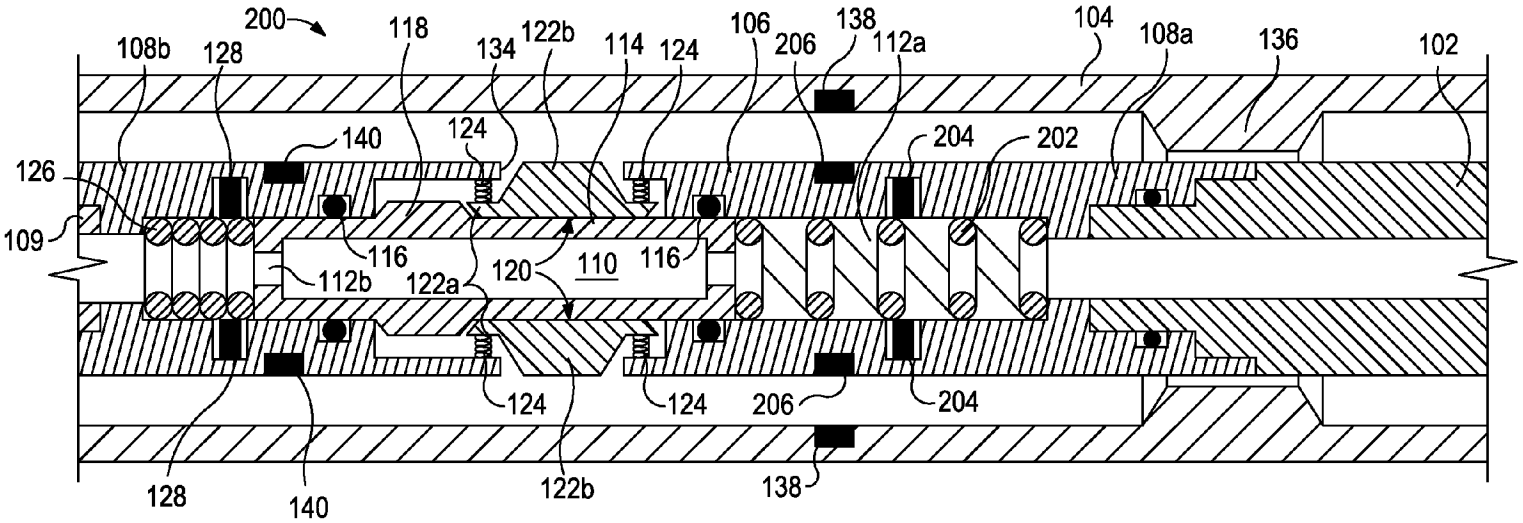

Referring now to FIGS. 2A-2C, illustrated are cross-sectional, progressive views of another exemplary positioning system 200, according to one or more embodiments. The positioning system 200 may be substantially similar to the positioning system 100 of FIGS. 1A-1B, and therefore may be best understood with reference thereto where like numerals represent like elements not described again in detail. Similar to the positioning system 100 of FIGS. 1A-1B, the positioning system 200 may include the sleeve 114 movably arranged within the housing 106 in response to the expansion of the biasing device 126.

The positioning system 200, however, may further include a second biasing device 202 arranged within the piston bore 110 at or near the first axial end 112*a*. The second biasing device 202 may be similar in form and function to the first biasing device 126, but may instead be configured to force the sleeve 114 back toward the second axial end 112*b* of the piston bore 110 upon proper actuation, as will be discussed in greater detail below. The positioning system 200 may further include a second set of actuators 204 (two shown), similar in function and form to the first set of actuators 128, and configured to maintain the second biasing device 202 in its stowed configuration until properly released.

FIG. 2A depicts the positioning system 200 (and accompanying wellbore servicing tool 102) as it is being introduced downhole into the production tubular 104 (from left to right), and both the first and second biasing devices 126 may be maintained in their stowed configurations by their corresponding sets of actuators 128, 204, respectively. As the positioning system 200 proceeds axially through the production tubular 104, the RFID readers 140 recognize the proximity of the corresponding RFID tags 138 and trigger the retraction of the actuators 128. Retracting the actuators 128 releases the biasing device 126 which forces the sleeve 114 toward the first axial end 112*a* and simultaneously extends the lugs 120 radially as the upset 118 slides beneath each lug 120. This is depicted in FIG. 2B. With the lugs 120 radially extended through the holes 134 defined in the housing 106, the lugs 120 are able to engage the profile 136 and thereby stop the axial movement of the wellbore servicing tool 102. At this time, the particular operation of the wellbore servicing tool 102 may be undertaken at the predetermined location.

When it is desired to remove or otherwise relocate the wellbore servicing tool 102 within the production tubular 104, the positioning system 200 may be configured to retract the lugs 120 back into the housing 106. Retracting the lugs 120 back into the housing 106 ensures that they will not impede the axial progress of the wellbore servicing tool 102, either uphole or downhole, at reduced-diameter sections of the production tubular 104.

Specifically, the positioning system 200 may further include a second set of RFID readers 206 (two shown) communicably coupled to the second set of actuators 204. Similar to the first set of RFID readers 140, the second set of RFID readers 206 may be coupled or otherwise attached to the outer circumferential surface of the housing 106 and configured to communicate electromagnetically with the one or more RFID tags 138. In some embodiments, the second RFID readers 206 may be configured to communicate sequentially with the RFID tags 138. For example, the second RFID readers 206 may be programmed or otherwise configured to trigger actuation of the second set of actuators 204 upon passing the RFID tags 138 a predetermined number of times, or in a predetermined sequence.

In one embodiment, for example, the second RFID readers 206 may be programmed to trigger actuation of the second set of actuators 204 upon passing the RFID tags 138 twice; first, as the wellbore servicing tool 102 is initially introduced into the production tubular 104 and the second RFID readers 206 initially pass the RFID tags 138, and second, as the wellbore servicing tool 102 is pulled back through the production tubular 104 (i.e., toward the surface) and the second RFID readers 206 traverse the RFID tags 138 for a second time. Upon encountering the RFID tags 138 the second time, the second RFID readers 206 may be configured or otherwise programmed to trigger the actuation of the second set of actuators 204.

Referring to FIG. 2C, once the second set of actuators 204 is radially retracted, the second biasing device 202 may be free to expand or otherwise extend from its stowed configuration (FIGS. 2A and 2B) to a deployed configuration, and in the process come into biasing engagement with the sleeve 114. In one or more embodiments, the second biasing device 202 may be stronger or otherwise exhibit a larger spring constant than the first biasing device 126. As a result, the second biasing device 202 may be able to overcome the spring force of the first biasing device 126 and thereby force the sleeve 114 back toward the second axial end 112*b*, while simultaneously re-compressing the first biasing device 126 within the piston bore 110.

As the sleeve 114 shifts toward the second axial end 112*b*, the upset 118 slides out axially from beneath the lugs 120 and the springs 124 urge the head portions 122*b* of each lug 120 back inside the housing 106. With the lugs 120 generally disposed within the housing 106 once more, the wellbore servicing tool 102 is prepared to be relocated within the production tubular 104, either uphole or downhole, without the lugs 120 impeding or otherwise obstructing the axial progress of the wellbore servicing tool 102 while traversing reduced-diameter sections of the production tubular 104.

Figure 3A:
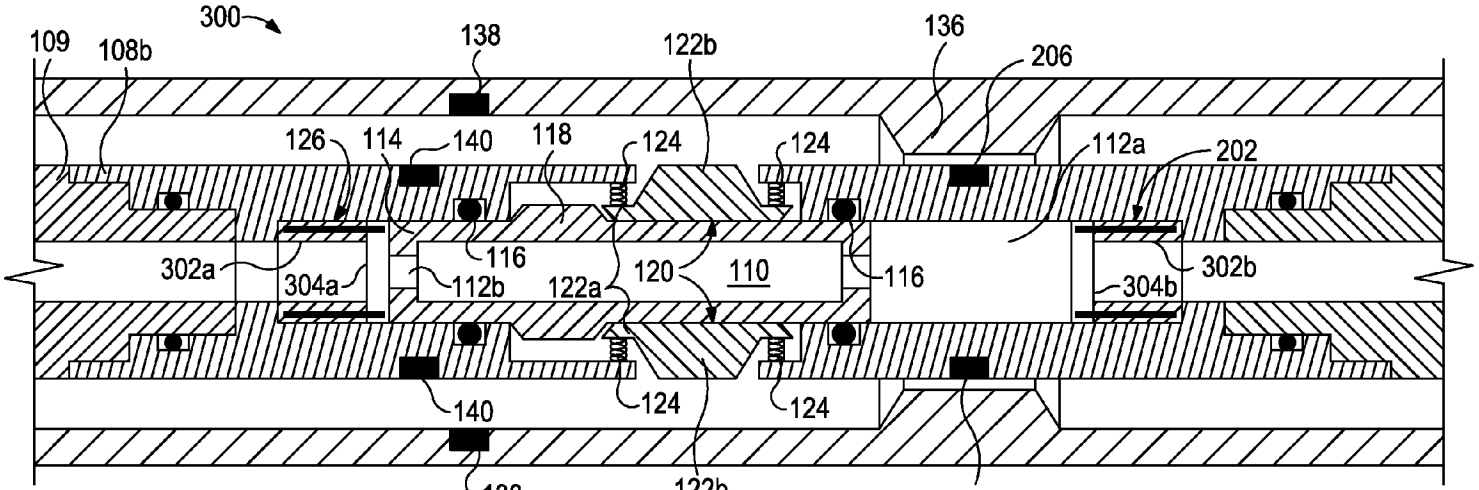
FIGS. 3A-3C illustrate cross-sectional, progressive views of another exemplary positioning system, according to one or more embodiments.
Figure 3B:
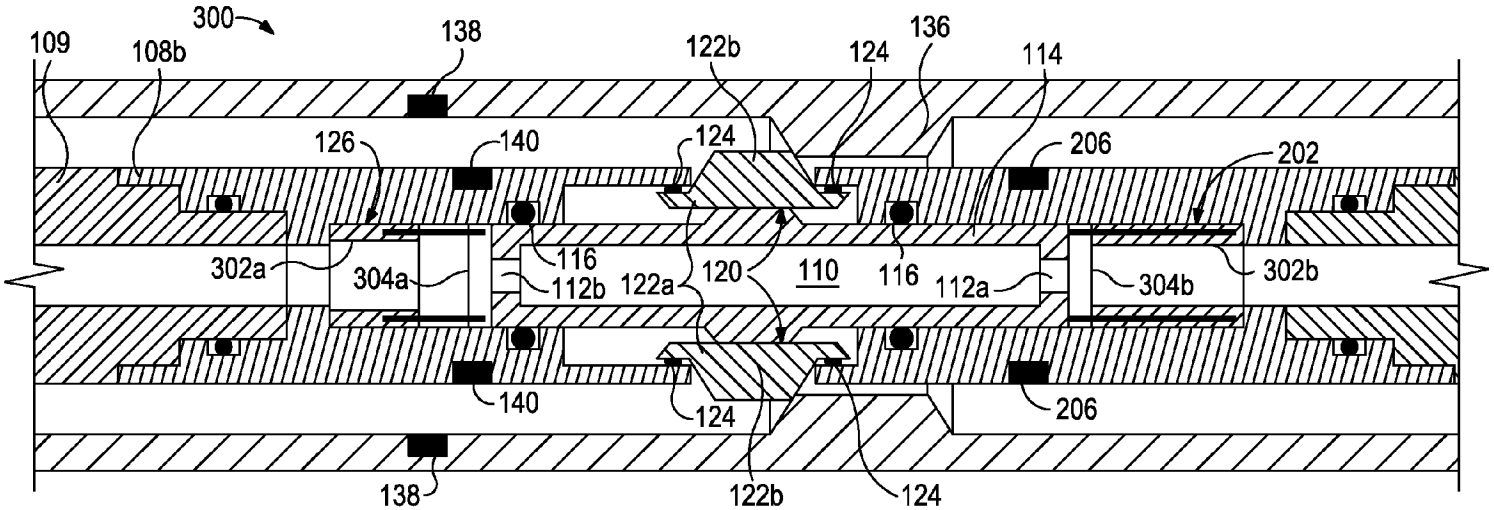
Figure 3C:
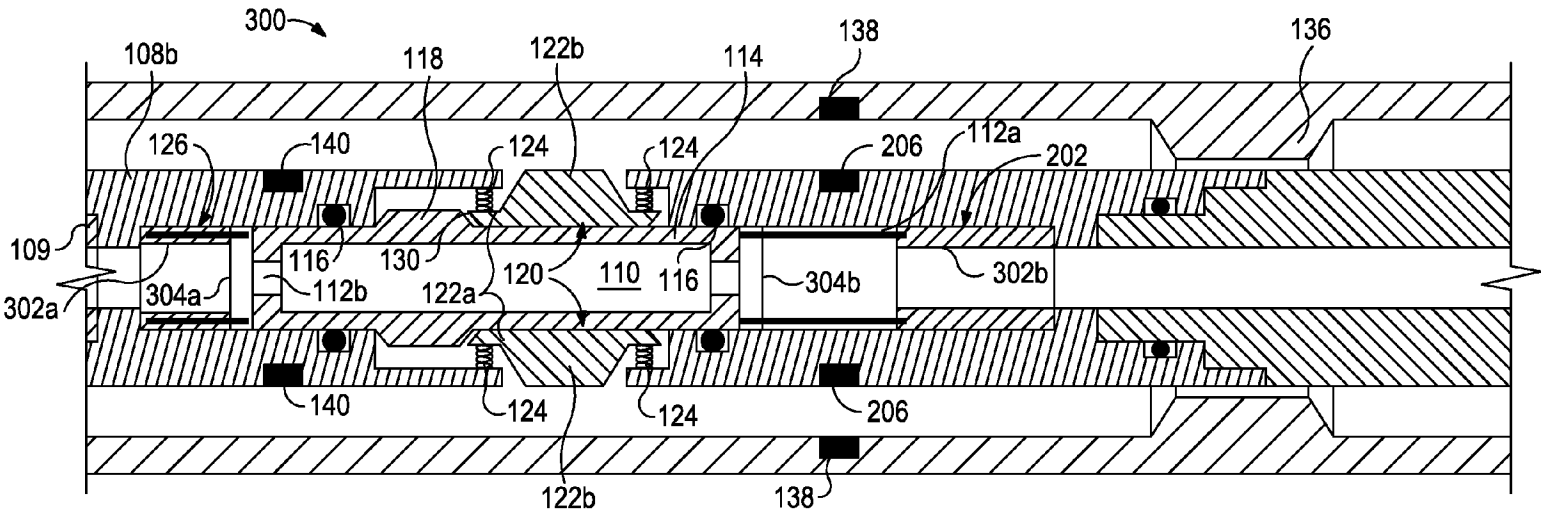

Referring now to FIGS. 3A-3C, illustrated are cross-sectional, progressive views of another exemplary positioning system 300, according to one or more embodiments. The positioning system 300 may be substantially similar to the positioning system 200 of FIGS. 2A-2C, and therefore may be best understood with reference thereto where like numerals represent like elements. Similar to the positioning system 200 of FIGS. 2A-2C, the positioning system 300 may be configured to radially extend and retract the one or more lugs 120 in order to strategically locate the wellbore servicing tool 102 at one or more predetermined profiles 136 arranged within the production tubular 104.

Unlike the positioning system 200 of FIG. 2, however, the first and second biasing devices 126, 202 of the positioning system 300 are not helical compression springs but instead may be replaced with linear actuators, or the like. Specifically, the first biasing device 126 may be a proximal linear actuator including a first solenoid 302*a* and a first plunger 304*a* movably arranged with respect to the first solenoid 302*a*, and the second biasing device 202 may be a distal linear actuator including a second solenoid 302*b* and a second plunger 304*b* movably arranged with respect to the second solenoid 302*b*. In some embodiments, the first biasing device 126 may be communicably coupled to the first RFID readers 140 such that the first RFID readers 140 are able to trigger the actuation of the first biasing device 126. Likewise, in some embodiments, the second biasing device 202 may be communicably coupled to the second RFID readers 206 such that the second RFID readers 206 are able to trigger the actuation of the second biasing device 202.

While the positioning system 300 illustrates linear actuators for each of the first and second biasing devices 126, 202, those skilled in the art will readily recognize that the first and second biasing devices 126, 202 may be any type of mechanically-movable device or electromechanical actuator, without departing from the scope of the disclosure. In some embodiments, for example, one of the first and second biasing devices 126, 202 may be a spring while the other may be a linear actuator, or vice versa.

As depicted in FIG. 3A, each of the first and second biasing devices are in their stowed configurations. In operation, as the positioning system 300 proceeds axially through the production tubular 104, the first RFID readers 140 recognize the proximity of the corresponding RFID tags 138, or a predetermined sequence thereof. As a result, the first RFID readers 140 may trigger the first biasing device 126 to move into its deployed configuration. Specifically, the first RFID readers 140 may trigger the actuation of the first plunger 304*a* axially toward the first axial end 112*a* of the piston bore 110 and into engagement with the sleeve 114. Moving the first plunger 304*a* toward the first axial end 112*a* may also force the sleeve 114 toward the first axial end 112*a*, which simultaneously extends the lugs 120 radially as the upset 118 slides beneath each lug 120. This is depicted in FIG. 3B, where the first biasing device 126 is shown in its deployed configuration. With the lugs 120 extended through the holes 134 defined in the housing 106, the lugs 120 are able to engage the profile 136 and thereby stop the axial movement of the wellbore servicing tool 102. At this time, the particular operation of the wellbore servicing tool 102 may be undertaken.

When it is desired to remove or otherwise relocate the wellbore servicing tool 102 to another location within the production tubular 104, the positioning system 200 may be configured to retract the lugs 120 back into the housing 106. In some embodiments, this may be accomplished by pulling the wellbore servicing tool 102 back toward the well surface such that the second set of RFID readers 206 may communicate with the one or more RFID tags 138. As with the embodiments described above with reference to FIGS. 2A-2C, the second RFID readers 206 in the positioning tool 300 may be configured to communicate sequentially with the RFID tags 138 and/or may otherwise be programmed to trigger the deployment of the second biasing device 202 upon passing the RFID tags 138 a predetermined number of times, or in a predetermined sequence.

In one embodiment, for example, the second RFID readers 206 may be programmed to deploy the second biasing device 202 upon passing the RFID tag(s) 138 twice; once as the wellbore servicing tool 102 is initially introduced into the production tubular 104 and the second RFID readers 206 initially pass the RFID tag(s) 138, and second as the wellbore servicing tool 102 is pulled back uphole through the production tubular 104 and the second RFID readers 206 pass the RFID tag(s) 138 for a second time. Upon encountering the RFID tag(s) 138 the second time, the second RFID readers 206 may trigger the actuation of the second biasing device 202, thereby resulting in the second plunger 304*b* being actuated axially toward the second axial end 112*b* of the piston bore 110 and into biasing engagement with the sleeve 114.

Referring to FIG. 3C, the second biasing device is shown in its deployed configuration. As the second plunger 304*b* moves axially toward the second axial end 112*b* it simultaneously forces the sleeve 114 in the same direction. In at least one embodiment, when the second biasing device 202 is actuated, the first biasing device 126 may be configured to de-energize, thereby allowing the second plunger 304*b* to force the sleeve 114 back toward the second axial end 112*b*, and simultaneously re-seat the first plunger 304*a* within the first solenoid 302*a*. In other embodiments, when the first RFID readers 140 are no longer able to communicate with the RFID tags 138, the first biasing device 126 may be configured to de-energize, thereby also allowing the second plunger 304*b* to force the sleeve 114 back toward the second axial end 112*b* and simultaneously re-seat the first plunger 304*a* within the first solenoid 302*a*.

As the sleeve 114 shifts toward the second axial end 112*b*, the upset 118 slides out axially from beneath the lugs 120 and the springs 124 urge the head portions 122*b* of each lug 120 back inside the housing 106. With the lugs 120 generally disposed within the housing 106 once more, the wellbore servicing tool 102 is prepared to be relocated within the production tubular 104, either uphole or downhole, without the lugs 120 impeding or otherwise obstructing the axial progress of the wellbore servicing tool 102 while traversing reduced-diameter sections of the production tubular 104.

Accordingly, the positioning tool 300 may prove advantageous in several respects. For example, the lugs 120 of the positioning tool 300 may be selectively deployed in order to locate the wellbore servicing tool 102 on several distinct locations or profiles 136 exhibiting a range of differing inner diameter sizes. This will allow operators to pass through upper restrictions having a reduced inner diameter size that may have been previously impossible using prior positioning systems. Moreover, the lugs 120 may be mechanically deployed and retracted multiple times, thereby allowing the wellbore servicing tool 102 to be located at multiple profiles 136 using the same positioning tool. Also, since the lugs 120 are mechanically deployed and retracted, operators do not have to worry about material fatigue limits or mechanical fatigue failure.

Those skilled in the art will readily recognize that several different sequences or patterns of RFID tags 138 may be employed to communicate with the corresponding RFID readers 140, 206 in order to properly actuate the exemplary positioning tools disclosed herein. The exemplary sequences and patterns of RFID tags 138, and their related embodiments described herein, are merely by way of example and therefore should not be considered limiting to the scope of the disclosure. In some embodiments, multiple RFID tags 138 may be arranged in series at predetermined locations along the length of the production tubular 104. In such embodiments, the RFID readers 140, 206 may be programmed to detect a particular sequence or number of RFID tags 138 before properly triggering the actuation of the actuators 128. As a result, this would allow the wellbore servicing tool 102 to have a selectable no-go feature, and several positioning tools 200, 300 could be stacked in series along the tubular string 109 and programmed to trigger the actuation of corresponding actuators 128 in response to different or predetermined RFID tag 138 sequences.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A positioning system for locating a wellbore servicing tool within a production tubular, comprising:

an elongate housing defining a piston bore having a first axial end and a second axial end;

a sleeve arranged within the piston bore and being axially translatable between the first and second axial ends, the sleeve having at least one upset extending radially outward therefrom;

one or more lugs arranged within the elongate housing and being radially movable when acted upon by the at least one upset;

at least one spring arranged between the one or more lugs and an inner radial surface of the piston bore, the at least one spring being configured to radially bias the one or more lugs against the sleeve;

a first biasing device arranged within the piston bore at the second axial end and movable between a stowed configuration and a deployed configuration; and at least one RFID tag arranged on the production tubular and configured to communicate with at least one RFID reader arranged on the elongate housing, the at least one RFID reader being configured to deploy the first biasing device upon communicating with the at least one RFID tag.

2. The positioning system of claim 1, wherein, as the first biasing device expands axially, it forces the sleeve toward the first axial end, thereby forcing the upset into engagement with the one or more lugs which radially extend at least partially without the elongate housing and engage a profile arranged on an inner radial surface of the production tubular.

3. The positioning system of claim 1, further comprising one or more actuators arranged within the elongate housing and communicably coupled to the at least one RFID reader, the one or more actuators being configured to maintain the first biasing device in the stowed configuration until triggered by the at least one RFID reader.

4. The positioning system of claim 3, wherein the one or more actuators are linear actuators.

5. The positioning system of claim 4, wherein the one or more actuators comprise an actuator selected from the group consisting of a mechanical actuator, an electromechanical actuator, a pneumatic actuator, a hydraulic actuator, and a piezoelectric actuator.

6. The positioning system of claim 1, wherein the at least one RFID reader comprises a first set of RFID readers, the positioning system further comprising:

a second biasing device arranged within the piston bore at the first axial end and movable between a stowed configuration and a deployed configuration; and a second set of RFID readers arranged on the elongate housing and communicable with the at least one RFID tag, the second set of RFID readers being configured to deploy the second biasing device upon communicating with the at least one RFID tag, wherein, as the second biasing device expands axially, it forces the sleeve toward the second axial end, thereby removing engagement between the upset and the one or more lugs and allowing the one or more lugs to radially retract.

7. The positioning system of claim 6, wherein the second set of RFID readers are configured to communicate sequentially with the at least one RFID tag.

8. The positioning system of claim 6, further comprising one or more actuators arranged within the elongate housing and communicably coupled to the second set of RFID readers, the one or more actuators being configured to maintain the second biasing device in the stowed configuration until triggered by the second set of RFID readers.

9. The positioning system of claim 8, wherein the one or more actuators are linear actuators.

10. The positioning system of claim 6, wherein at least one of the first and second biasing devices is a helical compression spring.

11. The positioning system of claim 6, wherein at least one of the first and second biasing devices is a linear actuator.

12. The positioning system of claim 11, wherein the linear actuator is communicably coupled to the first or second set of RFID readers and operable to deploy upon being triggered by the first or second set of RFID readers.

13. A method for locating a wellbore servicing tool within a production tubular, comprising:

introducing the wellbore servicing tool into the production tubular, the wellbore servicing tool being coupled to an elongate housing defining a piston bore having a first axial end and a second axial end;

communicating at least one RFID reader arranged on the elongate housing with at least one RFID tag arranged on the production tubular, and thereby deploying a first biasing device from a stowed configuration to a deployed configuration, the first biasing device being arranged within the piston bore at the second axial end;

moving a sleeve with the first biasing device toward the first axial end, the sleeve being arranged within the piston bore and having at least one upset extending radially outward therefrom;

engaging the at least one upset on one or more lugs arranged within the elongate housing, and thereby radially extending the one or more lugs at least partially without the elongate housing, wherein the one or more lugs are radially biased against the sleeve with at least one spring arranged between the one or more lugs and an inner radial surface of the piston bore; and engaging the one or more lugs on a profile arranged on an inner radial surface of the production tubular, thereby stopping an axial progression of the wellbore servicing tool.

14. The method of claim 13, further comprising:

maintaining the first biasing device in the stowed configuration with one or more actuators arranged within the elongate housing and communicably coupled to the at least one RFID reader; and triggering the one or more actuators with the at least one RFID reader in order to deploy the first biasing device.

15. The method of claim 13, wherein the at least one RFID reader comprises a first set of RFID readers, the method further comprising:

communicating a second set of RFID readers with the at least one RFID tag;

deploying a second biasing device arranged within the piston bore at the first axial end in response to communication between the second set of RFID readers and the at least one RFID tag;

forcing the sleeve toward the second axial end with the second biasing device, and thereby removing the upset from engagement with the one or more lugs; and radially retracting the one or more lugs.

16. The method of claim 15, wherein communicating the second set of RFID readers with the at least one RFID tag further comprises communicating the second set of RFID readers sequentially with the at least one RFID tag.

17. The method of claim 16, wherein communicating sequentially comprises communicating the second set of RFID readers with the at least one RFID tag a predetermined number of times.

18. The method of claim 15, further comprising:

maintaining the second biasing device in the stowed configuration with one or more actuators arranged within the elongate housing and communicably coupled to the second set of RFID readers; and triggering the one or more actuators with the second set of RFID readers in order to deploy the second biasing device.

19. The method of claim 15, wherein radially retracting the one or more lugs comprises biasing the one or more lugs into a retracted configuration with the at least one spring arranged between the one or more lugs and the inner radial surface of the piston bore.

20. The method of claim 15, wherein the first and second biasing devices are linear actuators communicably coupled to the first and second sets of RFID readers, respectively, the method further comprising:

deploying the first biasing device upon being triggered by the first set of RFID readers; and deploying the second biasing device upon being triggered by the second set of RFID readers.

21. The method of claim 15, further comprising repositioning the wellbore servicing tool in the production tubular at a new location.

* * * * *